US007877903B2

(12) United States Patent
Barteet

(10) Patent No.: US 7,877,903 B2
(45) Date of Patent: Feb. 1, 2011

(54) INTERCHANGEABLE SHOE-FORMING ASSEMBLY

(76) Inventor: Dominique Barteet, 12894 N. Normandy Way, Palm Beach Gardens, FL (US) 33410

( * ) Notice: Subject to any disclaimer, the term of this patent is extended or adjusted under 35 U.S.C. 154(b) by 889 days.

(21) Appl. No.: 11/689,165

(22) Filed: Mar. 21, 2007

(65) Prior Publication Data

US 2007/0266506 A1 Nov. 22, 2007

Related U.S. Application Data

(63) Continuation-in-part of application No. 10/263,179, filed on Oct. 3, 2002.

(51) Int. Cl.
*A43B 3/24* (2006.01)

(52) U.S. Cl. ..... 36/100; 36/101; 36/11.5

(58) Field of Classification Search ..... 36/15, 36/11.5, 100, 101
See application file for complete search history.

(56) References Cited

U.S. PATENT DOCUMENTS 2,112,761 A * 3/1938 Buehner ..... 36/11.5
2,221,132 A * 11/1940 Girardi ..... 36/33
2,607,133 A * 8/1952 Marlowe ..... 36/11.5
3,000,116 A * 9/1961 Ally ..... 36/101
3,553,754 A * 1/1971 Mendelsohn ..... 12/142 S
3,925,915 A * 12/1975 Colli ..... 36/11.5
4,450,633 A * 5/1984 Connelly ..... 36/101
4,461,102 A * 7/1984 DeVincentis ..... 36/101
5,992,058 A * 11/1999 Jneid ..... 36/100
6,640,464 B2 * 11/2003 Hsin et al. ..... 36/11.5
6,928,754 B2 * 8/2005 Cambronero ..... 36/11.5
7,272,899 B1 * 9/2007 Marak ..... 36/101
2002/0194750 A1 * 12/2002 Feick ..... 36/101
2003/0177664 A1 * 9/2003 Monassebian ..... 36/100
2003/0233772 A1 * 12/2003 Musial ..... 36/100
2005/0066550 A1 * 3/2005 Liu ..... 36/101
2006/0248753 A1 * 11/2006 Welsh ..... 36/101

* cited by examiner

*Primary Examiner*—Marie Patterson
(74) *Attorney, Agent, or Firm*—Feldman Gale, P.A.; Christopher P. Demetriades

(57) ABSTRACT

The invention provides a shoe having conveniently interchangeable components, such as a vamp and an ankle strap constructed for releasable attachment to the periphery of a sole member with the same fasteners. The components are easily removed and exchanged to alter the appearance of the shoe, thus providing a wearer with a variety of styles and/or decorative appearances in a single pair of shoes.

17 Claims, 9 Drawing Sheets

INTERCHANGEABLE SHOE-FORMING ASSEMBLY

CROSS REFERENCE TO RELATED APPLICATION

This application is a continuation-in-part of application Ser. No. 10/263,179, filed on Oct. 3, 2002 the contents of which are herein incorporated by reference.

FIELD OF THE INVENTION

The invention generally relates to footwear, particularly to a shoe having interchangeable components and most particularly to a shoe having conveniently interchangeable components such as a vamp and an ankle trap constructed such that they can be releaseably attached to the periphery of a sole member with the same fasteners.

BACKGROUND OF THE INVENTION

Although the basic function of footwear is protection of a person's feet, shoes are often viewed and purchased only with regard to fashion. For example, a person selects a particular pair of shoes to enhance and/or complement clothing worn and when the person changes clothing, since a single color and/or style of shoes will not match all colors and/or styles of clothing he/she, more often than not, must select another pair of shoes. Thus, in order to be fashionably dressed, a person must own many pairs of shoes.

Unfortunately, owning multiple pairs of shoes can be very expensive in terms of both cost and storage space. Footwear that is compatible with many styles of clothing would alleviate these disadvantages by reducing the number of pairs of shoes a person must own, thereby also freeing up storage space. An example of such footwear is shoes having interchangeable components.

The concept of footwear having interchangeable components for the purpose of fashion has long been known in the art. For example, U.S. Pat. No. 2,178,025 discloses a shoe having an upper that could be turned such that women can wear shoes to match their dresses without having to buy a new pair of shoes for each dress.

Typically, the first components introduced as interchangeable were the upper/vamp portions. U.S. Pat. No. 2,368,314 discloses a shoe having separable soles and uppers for transforming a sandal to a "fancy" shoe. U.S. Pat. No. 3,204,346 discloses a shoe having a single basic sole that can be used with a variety of colored uppers. U.S. Pat. No. 3,925,915 discloses a sandal having a removable vamp portion attached to the sidewall of a shoe bottom with snaps. U.S. Pat. No. 4,193,214 discloses a sandal having interchangeable vamps and soles such that many types of sandals can be created from the same basic shoe. U.S. Pat. No. 4,439,935 discloses a shoe having an interchangeable upper comprising a vamp and an insole. U.S. Patent Application Publication 2003/0233772 A1 discloses a shoe having interchangeable coverings, i.e. vamps/uppers, to alter the exterior appearance of the shoe. These coverings can be attached to the sole using snaps.

Interchangeable components other than uppers or soles have also been disclosed. U.S. Pat. No. 3,999,311 discloses a slip-on loafer-type shoe having exchangeable ornamental elements such as colored straps that fit across the front portion of the upper for altering the appearance of the shoe. U.S. Pat. No. 6,631,570 discloses a shoe having interchangeable heels with a wide range of styles and heights (low to high). U.S. Pat. No. 6,651,359 discloses an interchangeable shoe strap system including a plurality of decorative strap covers which are selectively coupable to a base strap for altering the overall appearance of the shoe. U.S. Patent Application Publication 2005/0066550 A1 discloses covers for fitting over an upper; the covers having various colors, materials, shapes and decorative surface patterns. Additionally, these shoes are disclosed as having soles in different shapes and heights.

The concept of shoes having interchangeable straps is also well-known. U.S. Pat. No. 3,902,259 discloses a sandal assembly comprising five elements, including straps, which can be individually replaced for purposes of repair or change of color combinations. U.S. Pat. No. 4,450,633 discloses a shoe comprising a sole constructed to be attached to the foot by any one of a plurality of pairs of different colored, styled, or textured straps which can be exchanged to match the clothes of the wearer. The straps are attached using ring anchors and can include jewelry ornamentation. U.S. Pat. No. 4,461,102 discloses a shoe having interchangeable straps attached to the sole using spring connectors. The straps are selected to be compatible with other attire with which the shoes will be worn. U.S. Pat. No. 5,992,058 discloses a shoe having multiple detachable straps that allow a wearer to change the style of the shoe as they desire. These straps can be attached to the sole using snap elements, U.S. Pat. No. 6,928,754 B2 discloses a detachable fastening for attaching straps to the sole of a shoe. The straps can be exchanged to coordinate with the clothes of the wearer. U.S. Patent Application Publication 2006/0150441 A1 discloses a shoe in which various components, such as heels and straps, are interchangeable for conversion into an array of different styles.

Although the interchangeable components of existing footwear have been used to enhance fashion by providing shoes that have alterable appearances, the aforementioned footwear does not provide for a shoe having one fastener system for attaching at least two distinct exchangeable members, such as a vamp portion and an ankle strap, to a shoe sole. Accordingly, it would be desirable to provide a shoe having a simple, convenient fastening system for attaching multiple interchangeable members, wherein the fastening system facilitates substantial aesthetic flexibility without affecting basic function of the shoe.

SUMMARY OF THE INVENTION

The instant invention relates to an interchangeable shoe-forming assembly comprising components that are removable and exchangeable to alter the appearance of the shoe, thus providing a wearer with a variety of styles and/or decorative appearances in a single pair of shoes. This assembly utilizes one fastening system to attach multiple exchangeable components, such, as an upper and an ankle strap, to a shoe sole, thus enabling a wearer to release and exchange components quickly and easily without the complication of additional fasteners.

Generally, the components of the shoe-forming assembly comprise a sole or shoe base member, a vamp or upper member, a strap member and fastening members. The shoe-forming assembly can also include a tote bag for carrying the assembled shoes and/or the components of the assembly or a hangar system for storing the shoes and/or components.

It is an objective of the instant invention to provide an interchangeable shoe-forming assembly comprising components that are conveniently removable and exchangeable to alter the appearance of the shoe, thus providing a wearer with a variety of styles and/or decorative appearances in a single pair of shoes.

It is an objective of the instant invention to provide a shoe having a simple, convenient fastening system capable of releasably attaching multiple interchangeable members to a shoe sole, wherein the fastening system facilitates substantial aesthetic flexibility without affecting the basic function of the shoe.

It is another objective of the instant invention to provide an interchangeable shoe-forming assembly that utilizes one fastening system to attach multiple exchangeable components, such as an upper and an ankle strap, to a shoe sole, thus enabling a wearer to release and exchange components quickly and easily.

It is yet another objective of the invention to provide a shoe having an easily alterable appearance thereby allowing a single pair of shoes to be worn with a variety of outfits.

An additional objective of the instant invention is to provide an interchangeable shoe-forming assembly designed to provide a practical shoe having convenient and easily replaceable vamp, strap members and/or decorative elements/adornments.

Another objective of the instant invention is to provide an interchangeable shoe-forming assembly including a vamp portion having a decorative element/adornment releasably attached to the outer surface.

A further objective of the instant invention is to provide an interchangeable shoe-forming assembly that permits a wearer to substantially alter the appearance of the shoes with minimal effort and cost.

Another objective of the instant invention is to provide an interchangeable shoe-forming assembly that provides many styles of shoes in a single pair, thus requiring little storage space.

Yet another objective of the instant invention is to provide a shoe which can be easily changed in appearance to match a variety of clothing, thereby substantially reducing the number of shoes required to be packed in one's luggage when traveling.

An additional objective of the instant invention is to provide an interchangeable shoe-forming assembly facilitating the discarding and replacement of components, such as vamps and straps, to keep up with current design and fashion trends.

Yet another objective of the instant invention is to provide an interchangeable shoe-forming assembly including a vamp portion that is bound by an edging material on the left and right peripheral sides, wherein the edging material strengthens the fasteners such that the vamp portion can withstand repeated release and exchange without breaking and/or wearing out.

A further objective of the instant invention is to provide an interchangeable shoe-forming assembly wherein the components, such as the vamps and straps, can be easily discarded and replaced, when worn out, broken or otherwise unusable.

Other objectives and advantages of the instant invention will become apparent from the following description taken in conjunction with the accompanying drawings wherein are set forth, by way of illustration and example, certain embodiments of the instant invention. The drawings constitute a part of this specification and include exemplary embodiments of the present invention and illustrate various objects and features thereof.

BRIEF DESCRIPTION OF THE FIGURES

The preferred embodiments of the instant invention will hereinafter be described in conjunction with the appended drawings provided to illustrate and not to limit the invention, and in which.

Like reference numerals refer to like parts throughout the several views of the drawings.

DETAILED DESCRIPTION OF THE INVENTION

Figure 1:
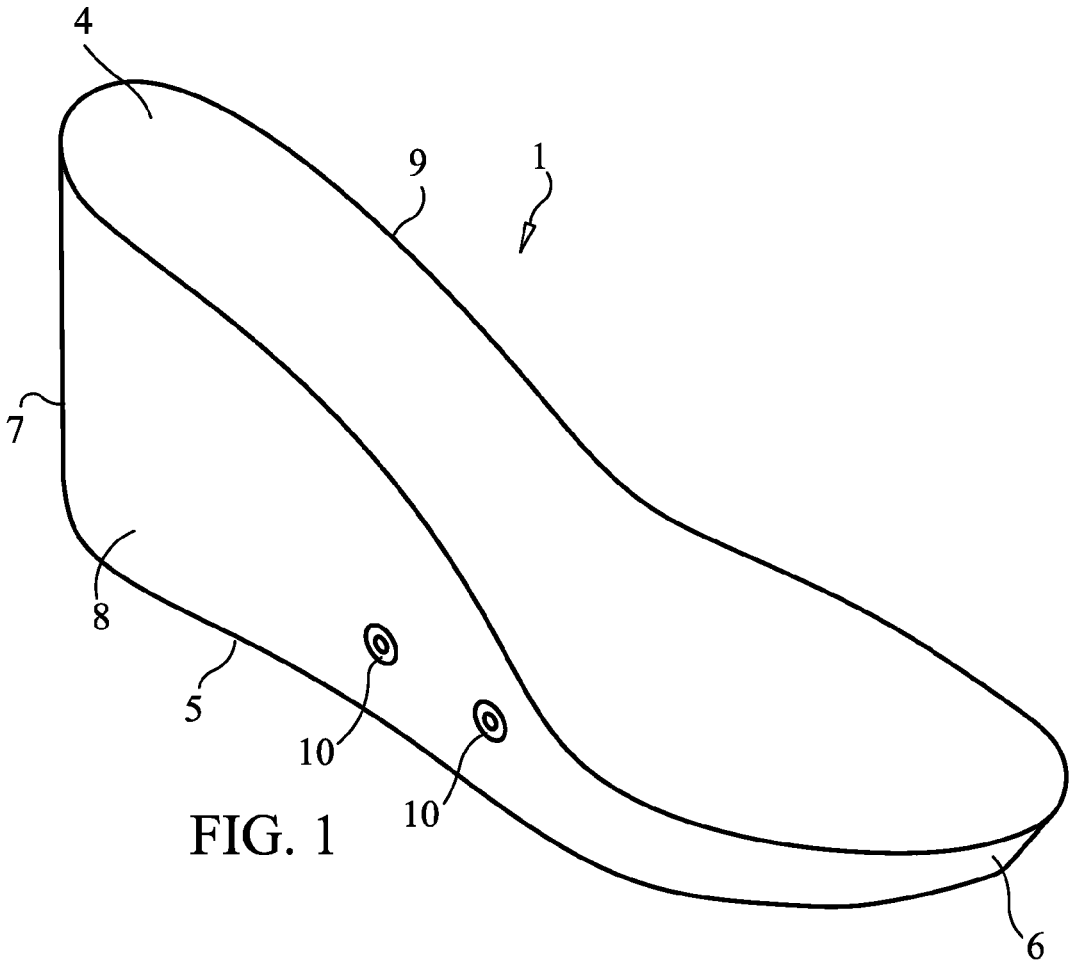
FIG. 1 is a side perspective view of a sole member of the interchangeable shoe-forming assembly.

For the purposes of promoting an understanding of the principles of the invention, reference will now be made to the embodiments illustrated in the drawings and specific language will be used to describe the same. However, the illustrated embodiments are merely exemplary. It is understood that no limitation of the scope of the invention is thereby intended. Any alterations and further modifications in the illustrated devices, and such further application of the principles of the invention as illustrated herein are contemplated as would normally occur to one skilled in the art to which the invention relates.

Shown throughout the figures, the instant invention is generally directed to footwear, particularly shoes and sandals having a simple, convenient fastening system capable of releasably attaching multiple interchangeable members to a shoe sole, wherein the fastening system facilitates substantial aesthetic flexibility without affecting the basic function of the shoe.

Figure 4:
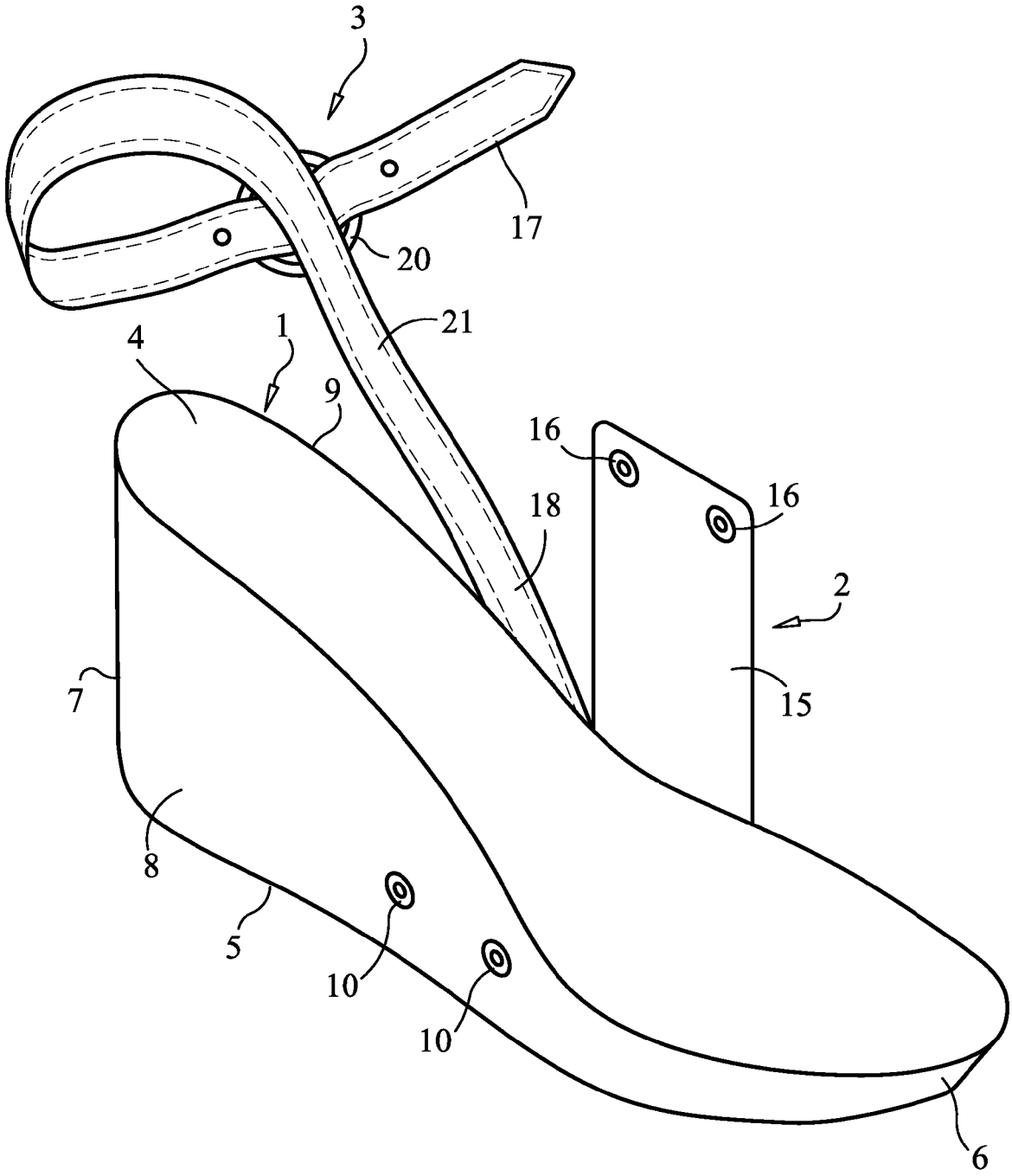
FIG. 4 is a side perspective view of the partially assembled shoe showing a strap member and one side of a vamp portion releasably attached to the sole member.
Figure 5:
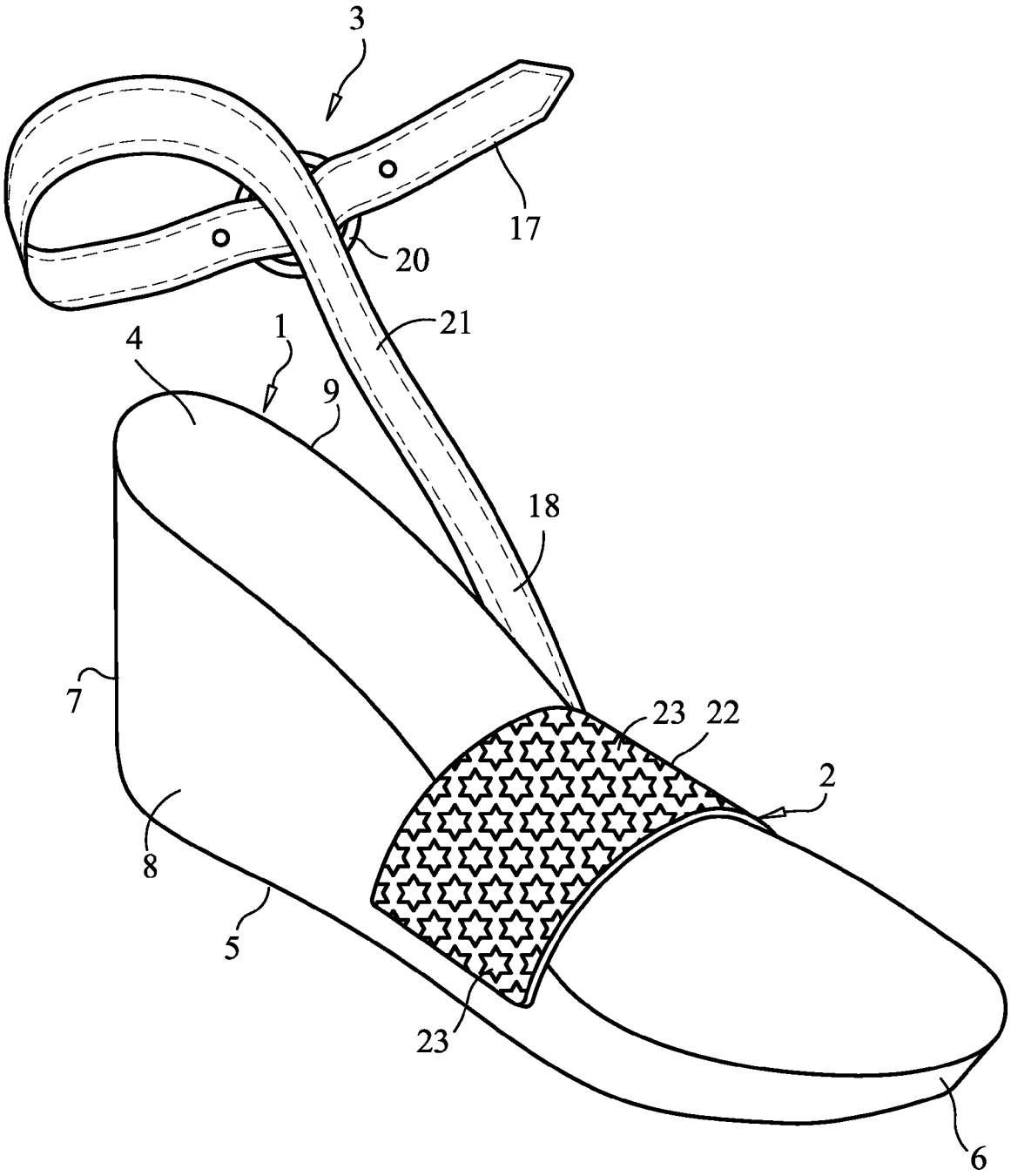
FIG. 5 is a side perspective view of the shoe fully assembled from components of the described interchangeable shoe-forming assembly.

An embodiment of the shoe, fully assembled from the interchangeble components of the described shoe-forming assembly, is illustrated in FIG. 5. This footwear is preferably in the form of a shoe or sandal and generally includes a sole or shoe base member 1, a vamp or upper member 2, 24, 38 or 41, a strap member 3 or 30 and fastening members, for example, fasteners 10 engaged in position with snap-receiving fasteners 16 (FIG. 4).

Figure 11:
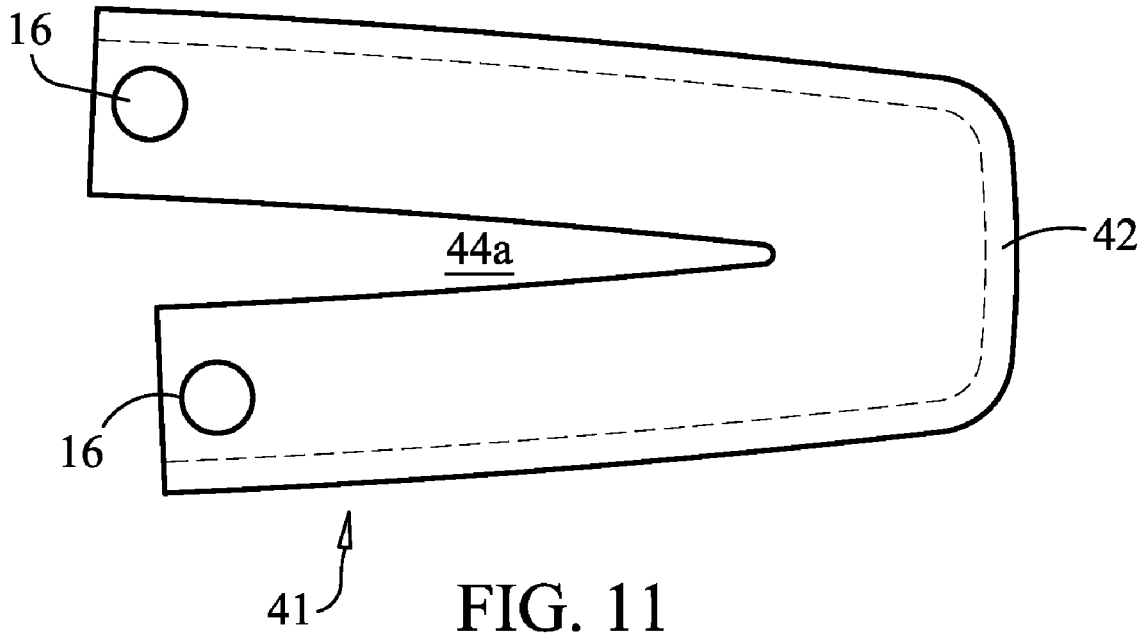
FIG. 11 is a top perspective view of the left side of a two-piece vamp member.
Figure 12:
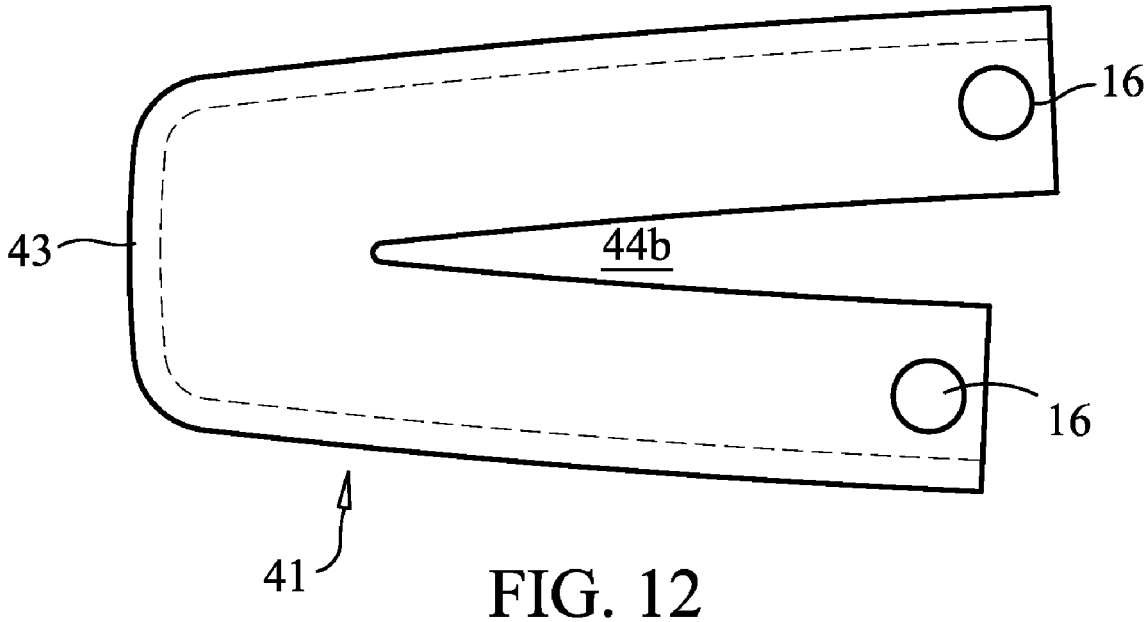
FIG. 12 is a top perspective view of the right side of a two-piece vamp member.

The sole or shoe base member 1 is illustrated in FIG. 1 and can be constructed from any known materials generally used in footwear construction, for example, albeit not limited to, polymer compositions, rubbers, foams and wood. The thickness of the sole may vary lengthwise in order to provide a flat or a raised heel design and can be shaped in any style, shape and/or height common to footwear design, for example, albeit not limited to, wedge, platform, platform-wedge, flat kitten heel and stiletto. The sole 1, as shown in FIGS. 1, 4, 5 and 13, is generally defined by upper and lower surfaces, 4 and 5, respectively, separated by contiguous right 8, left 9, front 6 and rear 7 peripheral surfaces. Mechanical snap-fastener members 10 are attached to and extend outwardly from the right and left peripheral surfaces, 8 and 9, respectively. The snap-fastener members 10 can be attached to the sole member 1 using rivets, adhesives or any other known means. The snap-fastener members 10 of the sole member 1 are configured for releasable snap-fit engagement with corresponding snap-receiving fastener members 16 of the vamp members 2 (FIG. 2), 24 (FIG. 6), 38 (FIGS. 9 and 10) or 41 (FIGS. 11 and 12).

The fasteners for releasably attaching the vamps 2, 24 38 or 41 and straps, 3 or 30 to the sole 1 are preferably mechanical snaps. Although the mechanical snap system is exemplified in the drawings, one of skill in the art would recognize that alternative means are available for providing the aforementioned releasable attachment. For example, albeit not limited to, alternatives to the mechanical snap system can include hook-and-loop type fasteners, velcro material and button and slot systems. However, it is desirable that the fastening means employed enables quick and easy replacement of the interchangeable members, i.e. the vamp, strap and/or decorative elements/adornments.

Figure 2:
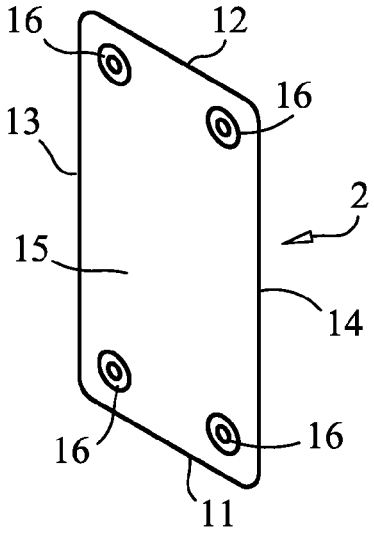
FIG. 2 is a bottom view of the lower surface of a vamp member of the interchangeable shoe-forming assembly.

A view of the lower surface 15 of the vamp or upper member 2 is shown in FIG. 2. Any of the disclosed vamps or upper members can be constructed from any known materials generally used in footwear construction, for example, albeit not limited to, polymer compositions, rubbers, foams, and natural materials, such as leathers. In the embodiment shown in FIG. 2 the vamp 2 is a single band having a rectangular or trapezoidal shape generally defined by upper and lower surfaces 22 (the upper surface 22 is shown in FIG. 5) and 15, respectively, separated by contiguous rear 13, front 14, left 11 and right 12 peripheral sides. All of the vamp members exemplified herein are preferably sized to fit across the upper portion of a wearer's foot (not shown), forward of the ankle and can be constructed in the form of a single band (FIGS. 2, 4, 5 and 8-10), multiple bands (FIG. 6) and 2-piece vamps (FIGS. 11-13) designed for attachment to the sole. Snap-receiving fastener members 16, corresponding to respective sole member snap fasteners 10, are shown attached to the lower surface 15 of vamp member 2. Snap-receiving fastener members 16 can be attached to vamp member 2, 24, 38 or 41 using rivets, adhesives or any other known means for attachment. In this manner, when a vamp member is snap-fittingly attached to a sole, it provides a means for securing the shoe to the foot (not shown) of a wearer. For example, toes and front portion of the wearer's foot are received through an opening defined between the lower surface 15 of vamp member 2 and upper surface 4 of sole member 1.

Figure 9:
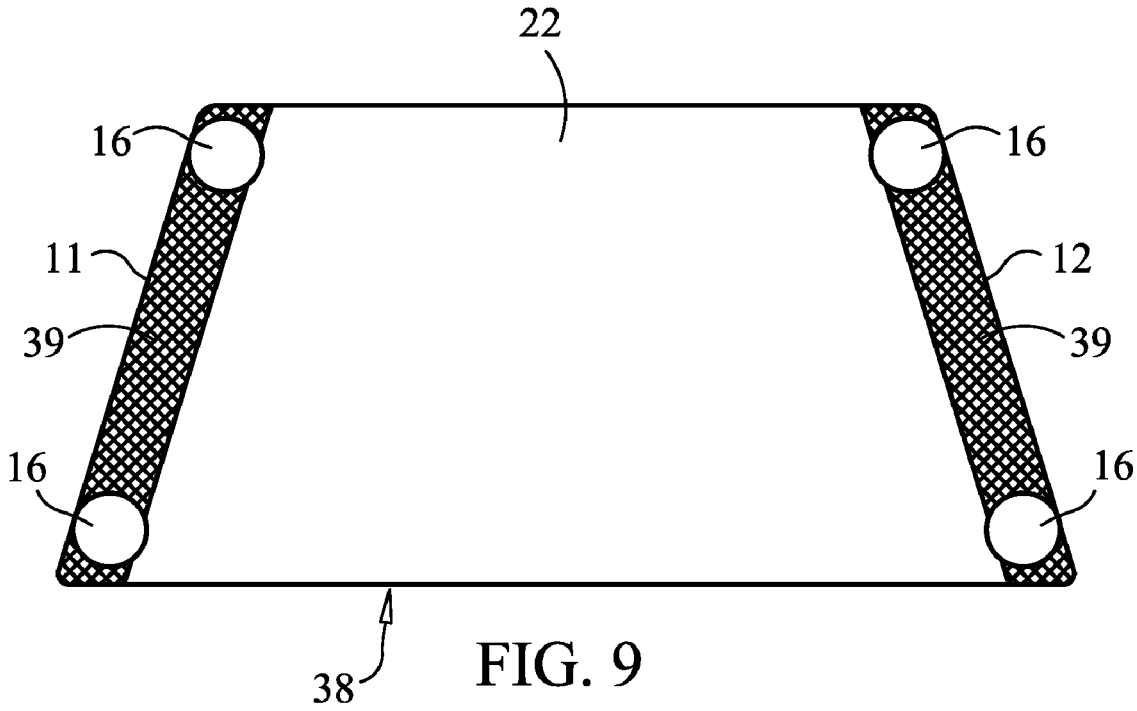
FIG. 9 is a top perspective view of a vamp member bound by edging material.
Figure 10:
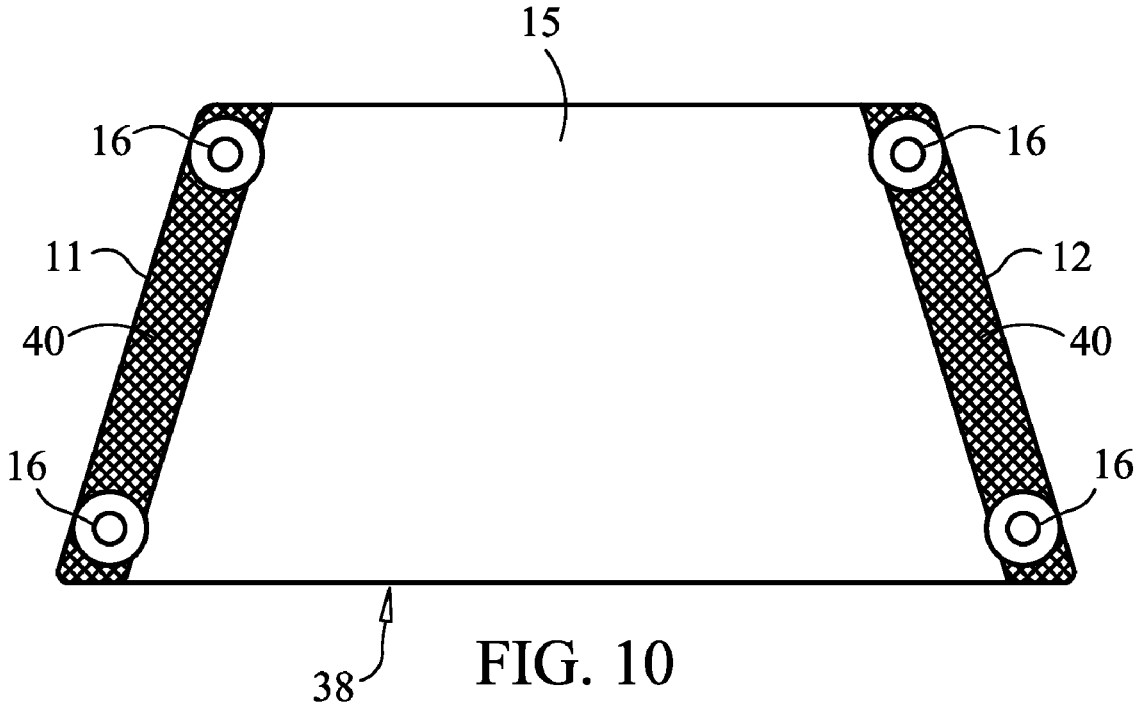
FIG. 10 is a bottom perspective view of a vamp member bound by edging material.

An alternative embodiment of a vamp member is the trapezoidal-shaped single band vamp member 38 shown in FIGS. 9 and 10. The peripheral sides, left 11 and right 12, of this vamp member 38 are bound by edging. The edging, 39 (FIG. 9, upper surface of vamp member) and 40 (FIG. 10, lower surface of vamp member) consists of an elongated, rectangular strip of material folded through the center, bound to and covering the right 12 and left peripheral sides 11 of vamp member 38. The edging generally covers (but is not limited to) about a half inch of the upper and lower surfaces of the vamp member, i.e. edging 39 covers upper surface 22 and edging 40 covers lower surface 15. The addition of edging strengthens the fasteners such that the vamp portion can withstand repeated release and exchange without breaking and/or wearing out. The edging is preferably constructed from, but is not limited to, a nylon material. Any known material that can strengthen the vamp (in. the area wherein the fasteners are attached) can be used. The snap-receiving fastener members 16 are attached and engaged with snap-receiving fasteners 10 through both the edging and the vamp.

Figure 6:
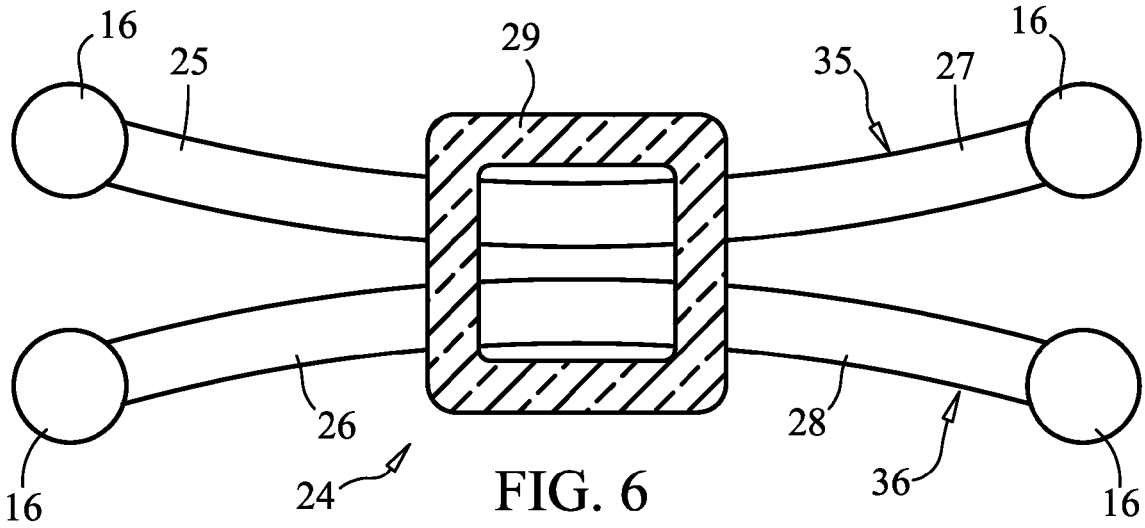
FIG. 6 is a top perspective view of an alternative embodiment of a vamp member.

Another embodiment of the vamp member Is illustrated in FIG. 6. Vamp member 24 is multi-banded and defined by two elongated rectangular-shaped bands, a front band and a rear band, 35 and 36, respectively. Front band 35 is generally defined by left surface 25 and right surface 27 and rear band 36 is generally defined by left surface 26 and right surface 28. Multi-banded vamp 24 can be snap-fittingly attached to sole member 1 by engagement of snap-receiving fastener members 16, with corresponding sole member snap fasteners 10.

Figure 13:
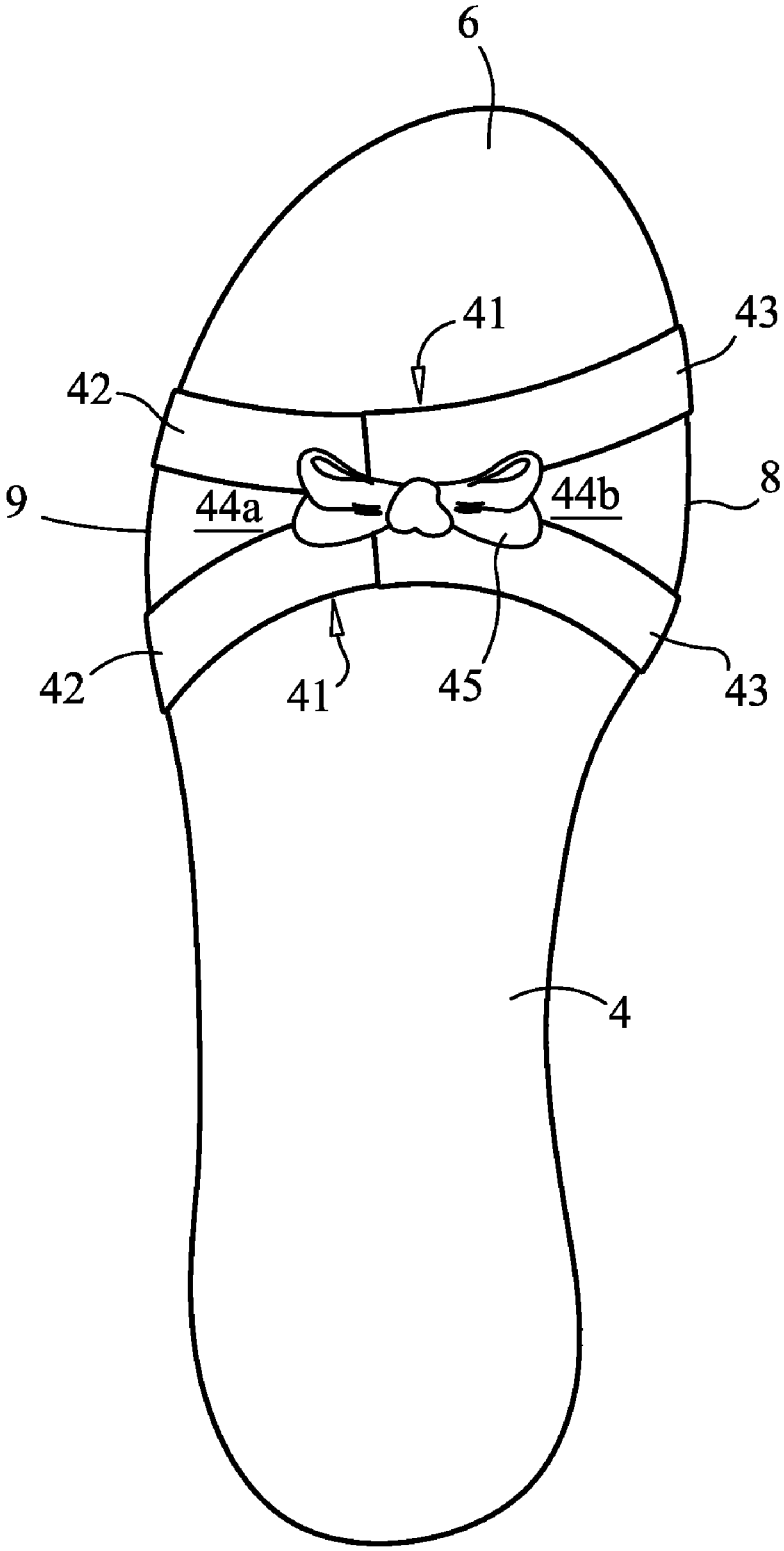
FIG. 13 is a top perspective view of the shoe fully assembled in the embodiment having a two-piece vamp member.
Figure 14:
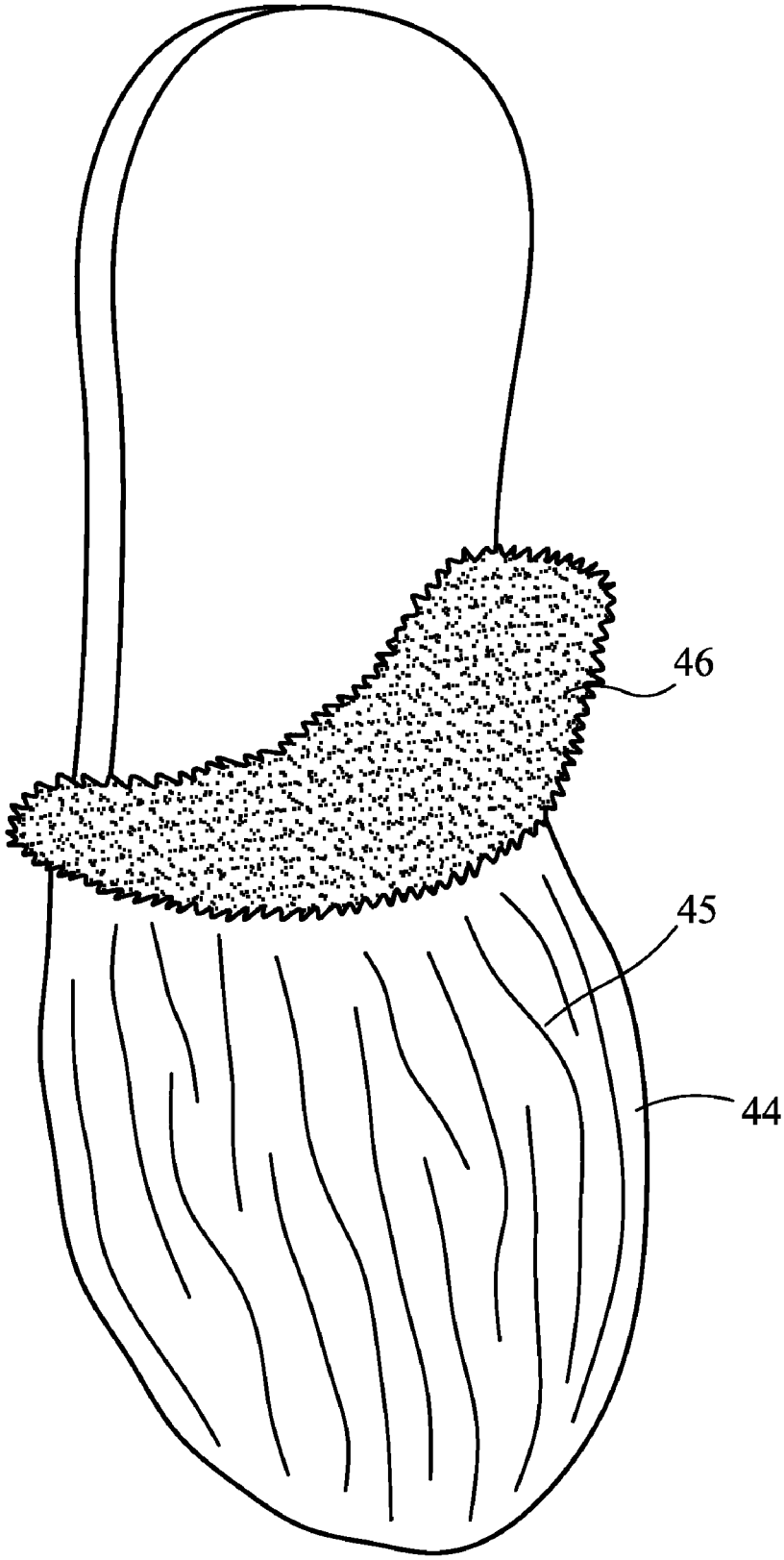
FIG. 14 is a top perspective of an alternative embodiment of a vamp member.

Another embodiment of the vamp member is illustrated in FIGS. 11-13, the two-piece vamp member 41. This vamp member includes two separate pieces, a left 42 (FIG. 11) piece and a right 43 (FIG. 12) piece that are releasably connected with a decorative element/adornment 45 (FIG. 13) to form the assembled vamp. Although the decorative adornment exemplified is a ribbon 45, any adornment capable of releasably attaching pieces 42 and 43 can be used. Illustrative, albeit non-limiting, examples include buttons, buckles, hooks, pins, shoe laces and beads. Each piece, left 42 and right 43, can be snap-fittingly attached to sole member 1 by engagement of snap-receiving fastener members 16, with corresponding sole member snap fasteners 10. When both pieces, 42 and 43, are connected with decorative adornment 45 to assemble vamp 41, two open spaces are formed, 44*a* on the left and 44*b* on the right, to enhance the decorative appearance of the shoe. FIG. 14 illustrates yet another embodiment of the vamp, 44, here a clog style. The vamp, 44, may be decorated as here in a pattern, 45, or may be a single or multiple colors. Furthermore, the vamp, 44, in the instant invention may be combined with other releasable decorative elements including, but not limited to the fur strap, 46, as shown herein.

Although single band 2, multiple band 24, edged 38, clog style, 44, and 2-piece 41 configured vamp members are exemplified in the figures, it will be apparent to those skilled in the art that various alternative vamp member shapes may be employed without departing from the scope of the invention.

The vamp members can be made of most any material or webbing and preferably include, for example with regard to vamp member 2, decorative elements 23 on the upper surface 22, and for example with regard to vamp 24, a decorative colored-metal element 29. These decorative elements can be, for example, albeit not limited to, rhinestones, crystals, sequins, beads, jewels, stitching, colored materials, such as metals and fabrics, textured materials and silk-screened-designs. Decorative elements provide an aesthetically pleasing and fashionable look to the described shoe. Any of a wide variety of means may be utilized to place decorative elements 23 on the upper surface 22 without departing from the scope of the instant invention. In one embodiment the decorative elements are applied using known silk-screen technology, such as that illustrated in FIG. 5. Alternatively, the decorative elements may be formed directly onto material by any of a number of techniques well-known in the art, for example, albeit not limited to, stitching.

Figure 8:
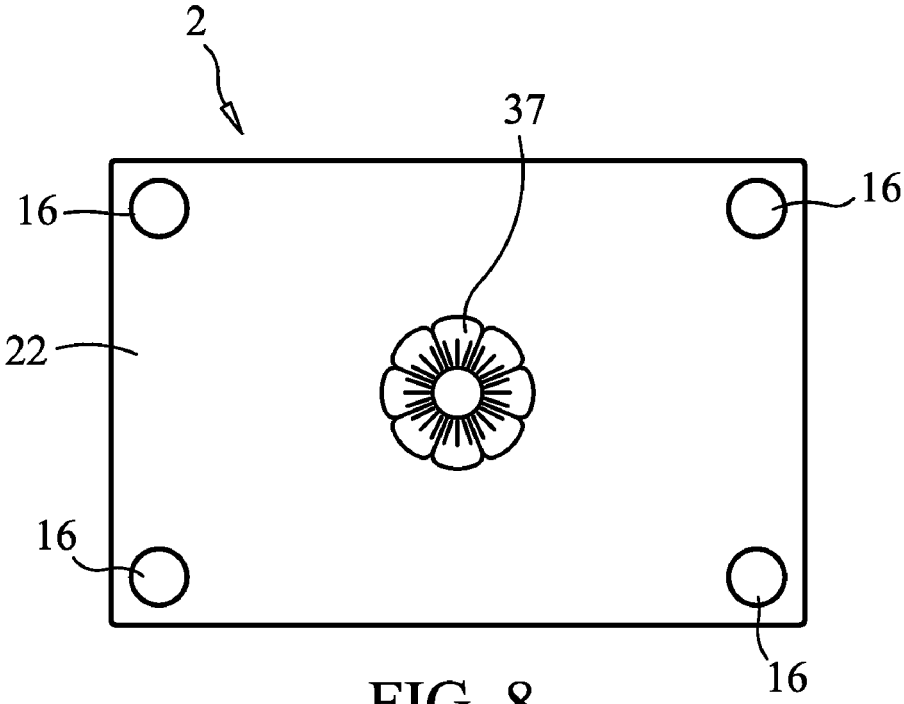
FIG. 8 is a top perspective view of an alternative embodiment of a vamp member.

In another embodiment, the decorative elements or adornments may be interchangeable. As shown in FIG. 8, the upper surface 22 of the vamp member 2 includes a flower-shaped button adornment 37. Although the adornment 37 exemplified is releasably attached to the upper surface 22 with a button and slot system, any known means available for the aforementioned releasable attachment can be used. Illustrative, albeit non-limiting, examples include mechanical snaps, hook-and-loop type fasteners and velcro material. Since the vamp members 2, 24, 38 and 41 are quickly and easily replaceable, it is seen that the wearer can replace the vamp as often as desired.

Figure 3:
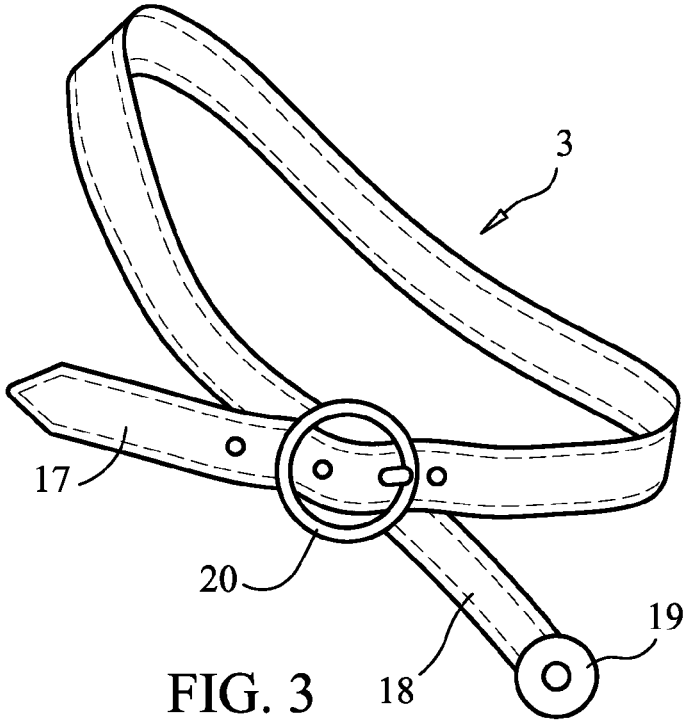
FIG. 3 is a top perspective view of a strap member of the interchangeable shoe-forming assembly.

One embodiment of the strap member is illustrated in FIGS. 3, 4 and 5. Strap member 3 has an elongated, rectangular shape and is generally defined by two opposing ends, a first end 17 having means for adjustably securing the strap member 3 around an ankle of the wearer (not shown) and a second end 18 that is releasably attachable to right 8 or left 9 peripheral surfaces of sole 1 by engagement with base member fasteners 10. The lower surface 21 of strap member 3 is shown in FIGS. 4 and 5. The strap member 3 can be constructed from any known materials generally used in footwear construction, for example, albeit not limited to, polymer compositions, rubbers, foams, and natural materials, such as leathers. A decorative colored-metal buckle 20 for adjustably securing the strap to the ankle of the wearer of the shoe is attached to first end 17. Although it is preferable to use a decorative buckle for adjustably securing the strap to the ankle of the wearer of the shoe, the invention is not limited to the use of such a buckle and any known means for adjustably securing the strap can be used. The strap member 3 is preferably releasably attachable to the sole 1 by engaging loop 19 with a snap fastener member 10.

Figure 7:
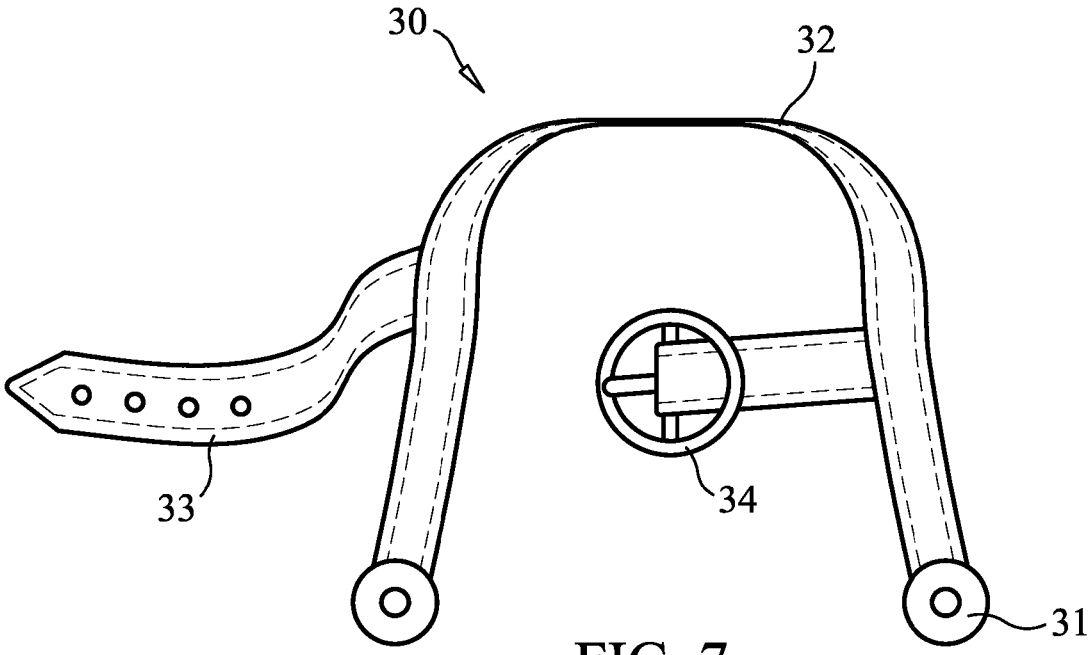
FIG. 7 is a top perspective view of an alternative embodiment of a strap member.
Figure 7A:
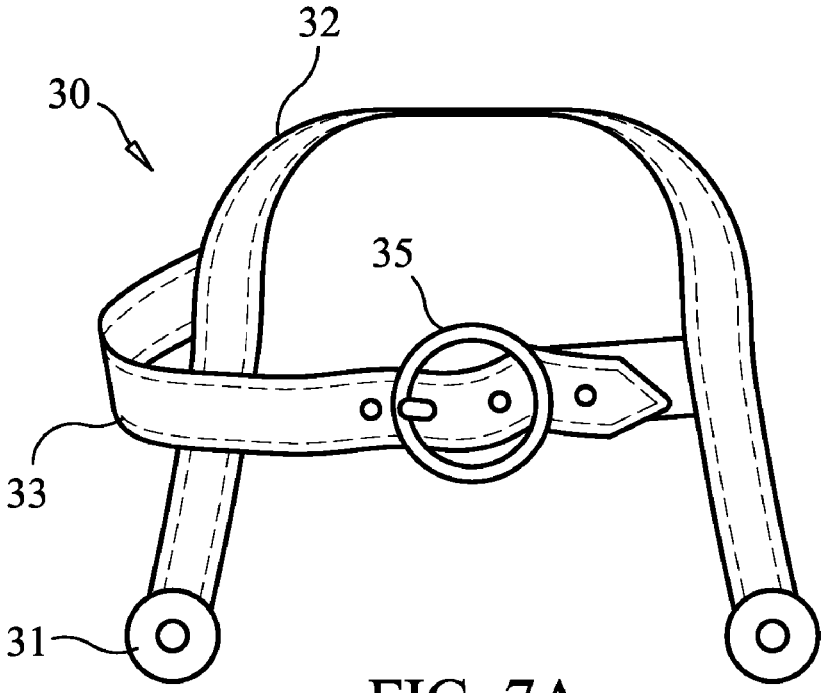

Another embodiment of the strap member is illustrated in FIGS. 7 and 7*a*. The strap member 30 can be constructed in the form of a base strap member 32 having two looped ends 31 that are releasably attachable to right 8 and left 9 peripheral surfaces of sole 1 by engagement with base member fasteners 10 and a second strap member 33 extending from the base strap 32. At least one end of the second strap 33 preferably has, but is not limited to, a buckle 34, in open position for adjustably securing the strap member 30 to the ankle of the wearer of the shoe (not shown). The buckle, 35, is shown in closed position.

Although the loop fasteners 19 and 31 are exemplified in FIGS. 3 and 7, respectively, it will be appreciated that a variety of alternative means are available for providing the releasable attachment of the strap to the sole. The strap members can also include decorative elements, for example, albeit not limited to, rhinestones, crystals, sequins, beads, jewels, stitching, colored materials, such as metals and fabrics, textured materials and silk-screened designs.

As evidenced from the above description and figures, the instant invention provides an interchangeable shoe-forming assembly that utilizes one fastening system to releasably attach multiple exchangeable components, such as an upper and an ankle strap, to a shoe sole, thus enabling a wearer to release and exchange components quickly and easily and achieve a variety of styles and/or decorative appearances in a single pair of shoes.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes any be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well, as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An interchangeable shoe-forming assembly for providing multiple decorative appearances in one pair of shoes comprising:

a sole member adapted to underlie a foot of a wearer and defined by an upper and a lower surface separated by a peripheral edge;

a vamp member releasably attachable to said peripheral edge of said sole member, the vamp member having an outer and an inner surface;

an elongated, rectangular strap member releasably attachable to said peripheral edge of said sole member; and fastening members for releasably attaching said vamp member and said strap member to said peripheral edge of said sole member;

whereby said vamp member and said strap member are releasably attached to said peripheral edge of said sole member with the same fastening members and are removable and exchangeable to provide many decorative appearances in one pair of shoes; and wherein said elongated rectangular strap member has two opposing ends, a first end comprising means for adjustably securing said strap member around an ankle of said wearer and a second end releasably attachable to said peripheral edge of said sole member.

2. The interchangeable shoe-forming assembly of claim 1 wherein said first end additionally comprises at least one decorative element selected from the group consisting of rhinestones, crystals, sequins, beads, jewels, stitching, colored materials and textured materials.

3. The interchangeable shoe-forming assembly of claim 1 wherein said second end is releasably attached to said peripheral edge of said sole with a loop positioned for engagement with said fastening members.

4. The interchangeable shoe-forming assembly of claim 1 wherein said fastening members comprise:

at least one pair of snaps attached to and extending from the right and left peripheral edges of said vamp member; and at least one pair of snap-receiving members attached to said peripheral edge of said sole member and positioned for engagement with said snaps.

5. The interchangeable shoe-forming assembly of claim 1 wherein said vamp member is sized to fit across the upper portion of a foot of said wearer and includes at least one decorative element on said outer surface.

6. The interchangeable shoe-forming assembly of claim 5 wherein said at least one decorative element is selected from the group consisting of rhinestones, crystals, sequins, beads, jewels, stitching; colored materials, textured materials and silk-screened designs.

7. The interchangeable shoe-forming assembly of claim 5 wherein said at least one decorative element is releasably attachable to said outer surface.

8. The interchangeable shoe-forming assembly of claim 1 wherein said vamp member is bound by an edging material on a right peripheral side and a left peripheral side.

9. The interchangeable shoe-forming assembly of claim 1 wherein said vamp member comprises at least two pieces releasably connected with a decorative element.

10. The interchangeable shoe-forming assembly of claim 5 wherein said at least one decorative element is releasably attachable to said outer surface.

11. An interchangeable shoe-forming assembly for providing multiple decorative appearances in one pair of shoes comprising:

a sole member adapted to underlie a foot of a wearer and defined by an upper and a lower surface separated by a peripheral edge;

a vamp member releasably attachable to said peripheral edge of said sole member, the vamp member having an outer and an inner surface;

an elongated, rectangular strap member releasably attachable to said peripheral edge of said sole member; and fastening members for releasably attaching said vamp member and said strap member to said peripheral edge of said sole member;

whereby said vamp member and said strap member are releasably attached to said peripheral edge of said sole member with the same fastening members and are removable and exchangeable to provide many decorative appearances in one pair of shoes; and wherein said elongated rectangular strap member comprises:

a base strap member having two ends releasably attachable to said peripheral edge of said sole member; and a second strap member extending from said base strap member wherein at least one end of said second strap member comprises means for adjustably securing said strap member around an ankle of said wearer.

12. The interchangeable shoe-forming assembly of claim 11 wherein said two ends are releasably attached to said peripheral edge of said sole member with loops positioned for engagement with said fastening members.

13. The interchangeable shoe-forming assembly of claim 11 wherein said fastening members comprise:

at least one pair of snaps attached to and extending from the right and left peripheral edges of said vamp member; and at least one pair of snap-receiving members attached to said peripheral edge of said sole member and positioned for engagement with said snaps.

14. The interchangeable shoe-forming assembly of claim 11 wherein said vamp member is sized to fit across the upper portion of a foot of said wearer and includes at least one decorative element on said outer surface.

15. The interchangeable shoe-forming assembly of claim 14 wherein said at least one decorative element is selected from the group consisting of rhinestones, crystals, sequins, beads, jewels, stitching; colored materials, textured materials and silk-screened designs.

16. The interchangeable shoe-forming assembly of claim 11 wherein said vamp member is bound by an edging material on a right peripheral side and a left peripheral side.

17. The interchangeable shoe-forming assembly of claim 11 wherein said vamp member comprises at least two pieces releasably connected with a decorative element.

* * * * *